US005156906A

United States Patent [19]

Holland

[11] Patent Number: 5,156,906

[45] Date of Patent: Oct. 20, 1992

[54] METHOD OF PRETREATING FABRICS IN IMPART SOIL RELEASE PROPERTIES THERETO

[75] Inventor: Richard J. Holland, Grosse Ile, Mich.

[73] Assignee: BASF Corporation, Parsippany, N.J.

[21] Appl. No.: 767,732

[22] Filed: Sep. 30, 1991

[51] Int. Cl.[5] ..... B05D 5/00; B32B 33/00

[52] U.S. Cl. ..... 428/264; 427/394; 428/265; 428/267; 428/272

[58] Field of Search ..... 427/394; 428/264, 265, 428/267, 272

[56] References Cited

U.S. PATENT DOCUMENTS 3,557,039 1/1971 McIntyre et al. ..... 260/29.2
4,569,772 2/1986 Ciallella ..... 252/8.6
4,746,456 5/1988 Kud et al. ..... 252/174.24
4,846,994 7/1989 Kud et al. ..... 252/174.21
4,846,995 7/1989 Kud et al. ..... 252/174.21
4,849,126 7/1989 Kud et al. ..... 252/174.23
4,999,869 3/1991 Holland et al. ..... 8/115.62

OTHER PUBLICATIONS

Bille et al. "Finishing for Durable Press and Soil Release" *Textile Chemist and Colorist* (1969) p. 600.

*Primary Examiner*—James C. Cannon

[57] ABSTRACT

A method of pretreating fabrics and textiles to impart soil release properties involves contacting the fabrics with a graft copolymer of polyoxyethylene terephthalate/polyethylene terephthalate with vinyl acetate or vinyl propionate.

12 Claims, No Drawings

METHOD OF PRETREATING FABRICS IN IMPART SOIL RELEASE PROPERTIES THERETO

FIELD OF THE INVENTION

The present invention relates to the use of certain polycondensates with vinyl esters in laundry pretreatments, and more specifically, to the use of graft copolymers of polyethylene terephthalate / polyoxyethylene terephthalate with vinyl propionate and/or vinyl acetate as soil release agents in the pretreatment of fabrics to impart soil release properties thereto.

BACKGROUND OF THE INVENTION

Fabrics woven from many synthetic fibers, and especially from polyester or blends comprising polyester and cotton fibers, are often very difficult to clean with conventional washing apparatus, e.g. washing machines. Polyester fibers are relatively easy to stain with oily (lipophilic) soils, but at the same time are difficult to wet in aqueous solution due to their hydrophobicity.

Textile manufacturers have addressed these problems by applying soil release finishes to these fabrics. These soil release finishes are most often hydrophilic in nature and can thus enhance the wetting of the fabrics by detergent solutions. This in turn helps to promote the rollup of oily soils during the wash cycle. The soil is removed from the fabric and transferred to the detergent. Thus, these surface coatings are known to impart soil release properties to fibers and fabrics so treated. The soil release finish can also act as a barrier between the surface of the fabric and the soil.

Soil release finishes can be applied to textiles in a variety of ways. In some cases, a non-permanent coating can be deposited in the rinse cycle of a conventional laundry process. In instances where a more permanent finish is required, the overlayer can be "heat set" to the fabric by drying at elevated temperatures often with mechanical pressure on the textile.

Often times, however, the surface coating and concomitant soil release capability is imparted to the fabric during a pretreatment process in which an aqueous bath is employed. The aqueous bath will often contain a pretreatment polymer with concentrations often ranging from 0.05–15% active. The pretreatment process basically comprises contacting the fabric surfaces with a dispersion of the graft copolymer, drying the textile surface and then heat setting the finish using a device such as, for example, a hot clothes iron.

U.S. Pat. No. 4,999,869 describes soil release polymers made of polyalkylene oxide and vinyl esters which are used during the pretreatment process.

Distinct from the concept of "soil release" is what is referred to as "anti-soil redeposition". The latter is a process which prevents the redeposition of soil which has already dissolved or dispersed in the wash water. It is obvious that the functions of the detergents and the surface finishing chemicals must supplement each other in the anti-redeposition process. But although the anti-redeposition process is often confused with soil release, it is not the same thing. In fact, there is very little direct connection between the two. In this regard, see Bille et al., "Finishing for Durable Press and Soil Release", *Textile Chemist and Colorist*, vol. 1, No. 27 (1969).

Numerous polymers have been described as anti-redeposition agents. U.S. Pat. No. 4,746,456 describes anti-redeposition agents made of polyalkylene oxides and vinyl acetate. U.S. Pat. Nos. 4,846,994 and 4,846,995 are directed to soil anti-redeposition with polyalkylene oxide and vinyl esters.

U.S. Pat. No. 4,849,126 relates to soil anti-redeposition agents with polycondensates based on polyesters, polyester urethanes and polyester amides grafted with certain vinyl esters. For example, polyesters of terephthalic acid may be grafted with vinyl acetate. While disclosing the after-treatment of a fabric surface to impart anti-redeposition properties utilizing the graft polymers set forth therein, the '126 patent makes no reference of employing these polymers for the pretreatment of the fabric to impart soil release properties thereto.

There presently exists a need in the art for a method of pretreating fabric and textile surfaces with certain graft copolymers so that important soil release properties may be imparted thereto.

OBJECTS OF THE INVENTION

It is therefore an object of the present invention to provide a method of pretreating fabrics and textiles with dispersions of graft copolymers made from certain polycondensates and vinyl esters so as to impart soil release properties thereto.

It is a further object of the present invention to utilize graft copolymers of polyethylene terephthalate / polyoxyethylene terephthalate with vinyl acetate and/or vinyl propionate in the pretreatment of fabric surfaces.

It is another object of the invention to provide for the use of the above graft copolymers to pretreat fabrics made of polyester and blends of polyester and cotton, as well as other synthetic fabrics such as polyamides.

A further object is to provide fabrics treated according to the method of the invention.

SUMMARY OF THE INVENTION

These and other objects of the invention are achieved by providing a method for the pretreatment of fabrics and textiles to impart soil release properties thereto, which involves contacting the fabrics with a dispersion of a graft copolymer. The graft copolymer will comprise (a) about 1 part by weight of at least one polycondensate comprising polyethylene terephthalate and polyoxyethylene terephthalate units. The polycondensate in turn will be grafted with (b) from about 0.2 to 10 parts by weight of at least one ester selected from the group consisting of vinyl acetate and vinyl propionate, as well as mixtures thereof. Together the polycondensate and the vinyl ester will comprise the graft copolymer.

As part of the invention, fabrics and textiles treated according to the method outlined above are also provided.

DETAILED DESCRIPTION OF THE PREFERRED EMBODIMENTS

As stated herein, the term "soil release properties" refers to the ability of an additive, e.g. a polymer, to impart hydrophilic character to the surface of a fabric which allows the soil to penetrate to a certain extent and which develops its activity during laundering, when its special functional groups remove soil from the fabric and transfer it to the detergents.

To prepare the graft copolymers of polyethylene terephthalate (PET) / polyoxyethylene terephthalate (POET) with vinyl acetate and PET / POET with vinyl propionate useful in practicing the method of the invention, the procedures set forth in U.S. Pat. Nos. 3,557,039 and 4,849,126 may be utilized.

The polyethylene terephthalate / polyoxyethylene terephthalate (PET/POET) polycondensates to be used for preparing the graft copolymers are known from U.S. Pat. No. 3,3557,039, which is incorporated herein by reference. The PET/POET polycondensates are obtained by the condensation reaction of terephthalic acid or dimethyl terephthalate with ethylene glycol or with polyethylene glycol of an average molecular weight of from about 1,000 to about 4,000. In place of the polyethylene glycol it is also possible to use alpha, omega-diaminopolyethylene glycol in the condensation. The condensation may additionally be carried out in the presence of caprolactam. The polycondensate will contain about 10–50% by weight of ethylene terephthalate repeat units together with 90–50% by weight of polyoxyethylene terephthalate repeat units. The molar ratio of polyethylene terephthalate to polyoxyethylene terephthalate units will be within the range of about 2:1 to 6:1, preferably about 5:2 to 5:1, more preferably about 3:1 to 4:1, and most preferably about 3:1.

Once the polyethylene terephthalate / polyoxyethylene terephthalate polycondensate product is obtained, the product is then grafted with at least one of vinyl acetate or vinyl propionate or mixtures thereof to obtain the graft copolymer. For every one part of PET/POET polycondensate product utilized, there is from about 0.2 to about 10, preferably from about 0.5 to about 6 parts by weight of the vinyl ester(s) utilized.

The graft polymerization is carried out in a conventional manner, and the procedures set forth in U.S. Pat. No. 4,849,126 are especially useful. The graft polymerization is carried out as usual in the presence of polymerization initiators, but it can also be carried out by the action of high-energy radiation, which includes the action of high-energy electron beams. A possible way of carrying out the graft polymerization comprises, for example, dissolving the polycondensates in at least one of the vinyl esters, adding a polymerization initiator and polymerizing the mixture to completion. The graft polymerization can for example also be carried out semicontinuously by first introducing a portion, for example 10%, of the mixture to be polymerized, comprising polycondensate, at least one vinyl ester and initiator, heating to the polymerization temperature and, after the polymerization has started adding the remainder of the mixture to be polymerized at a rate commensurate with the rate of polymerization. The graft polymers can also be obtained by introducing the polycondensates in a reactor, heating to the polymerization temperature and adding at least one vinyl ester and polymerization initiator either all at once, a little at a time or preferably uninterruptedly, and polymerizing to completion. For every part by weight of polycondensate, from about 0.2 to about 10, preferably from about 0.5 to about 6, parts by weight of at least one vinyl ester is utilized.

Suitable polymerization initiators are mainly organic peroxides, such as diacetyl peroxide, dibenzoyl peroxide, succinyl peroxide, di-tert-butyl peroxide, tertbutyl perbenzoate, tertbutylperpivalate, tert-butyl permalemate, bis(o-toluoyl) peroxide, didecanoyl peroxide, dioctanoyl peroxide, dilauroyl peroxide, ditert-butyl perisobutyrate, tert-butyl peracetate, di-tert-amyl peroxide, tert-butyl hydroperoxide and mixtures thereof, redox initiators and azo starters.

The graft polymerization is carried out at from about 50 to 200 degrees C., preferably at from about 70 to 140 degrees C. It is customarily carried out under atmospheric pressure, but can also be carried out under reduced or superatmospheric pressure. If desired, the graft polymerization described above can also be carried out in a solvent. Suitable solvents are, for example, alcohols, e.g. methanol, ethanol, n-propanol, isopropanol, n-butanol, sec-butanol, tertbutanol, n-pentanol, n-hexanol and cyclohexanol, and also glycols, such as ethylene glycol, propylene glycol and butylene glycol, as well as the methyl or ethyl ethers of 2-hydric alcohols, diethylene glycol, triethylene glycol, glycerol and dioxane. The graft polymerization can also be carried out with water as solvent. In this case, the first step is to introduce a solution which, depending on the amount of added vinyl ester, is more or less soluble in water. To transfer water-insoluble products which can form during the graft polymerization into solution, it is possible, for example, to add organic solvents to the reaction mixture, for example, isopropanol, n-propanol, methanol, acetone, dimethylformamide or even ionic or nonionic surfactants. It is even possible to use protective colloids, for example, polyvinyl alcohol, for this purpose.

Once grafting is complete, a dispersion of the graft copolymer so obtained is prepared. To obtain the dispersion, from about 0.5 to about 15%, and preferably from about 0.5 to 5%, and most preferably about 2% of the active graft copolymer is utilized. The active is dispersed in a suitable solvent or dispersing agent. Preferably, the agent is a combination of about 95% ethanol and 5% water by weight. Other alcohols, for example methanol, propanol and isopropanol, as well as mixtures thereof, may also be used to disperse the graft copolymer.

The textile or fabric to be treated according to the method of the invention is first brought into contact with the dispersion of the graft copolymer. Contact is effected primarily by immersing and soaking the textile in the dispersion. The fabric is soaked in the dispersion for a period of about 0.5 to 60 minutes, and preferably for about 10 minutes. After soaking is completed, the fabric is then dried using for example a heat gun. The fabric may then be heat set using a clothes iron.

The fabrics pretreated according to the method of the invention include polyester, as well as blends of polyester and cotton, and other synthetic fibers such as polyamides. It is also within the scope of the invention to pretreat other fabrics to impart soil release properties thereto. The aforementioned pretreated fabrics may then be utilized in apparel/clothing and textile manufacturing to produce a wide array of finished and semifinished goods where the benefits of pretreatment are desired. Such products may include for example shirts, blouses, pants, skirts, dresses, linens, towels, as well as the wholesale material which is utilized to produce these goods.

The following examples are provided to illustrate various aspects of the invention, but in no way should be construed as limiting the scope thereof:

PERFORMANCE TEST RESULTS

To illustrate that the method of pretreating fabric surfaces according to the invention imparts superior soil release properties to the fabrics so treated, the following illustrative tests were conducted:

Three fabric types (5 replicates of each type set forth below) were soaked in a dispersion of the graft copolymer for 10 minutes at room temperature, removed from the dispersion bath and placed on a metal rack. The swatches were dried with a heat gun and placed between two pieces of aluminum foil. Each fabric was pressed with a clothes iron (setting=5; cotton) for two minutes on each side and allowed to cool. Three drops of dirty motor oil (obtained from a 1975 Ford Granada) were added to each swatch and the stain was allowed to wick overnight. Reflectance readings were taken with a Hunter colorimeter for each stained fabric (Rd2). The swatches were washed at 120 degrees F. in moderately hard water (150 ppm) using a Whirlpool Imperial washer (17 gallons). A ten minute cycle was employed and one cup of non-phosphate TIDE ® brand detergent was added to clean the swatches. The fabrics were dried for 30 minutes in a Whirlpool Imperial dryer and reflectance readings for the washed swatches (Rd3) were measured. Standard clean swatches were used to determine an initial reflectance value (Rd1) for each fabric type. Percent soil release (%SR) was calculated according to the following equation:

$$\frac{(Rd3 - Rd2)}{(Rd1 - Rd2)} \times 100 = \% SR$$

where

Rd1=the reflectance of the virgin fabric.

Rd2=the reflectance of the stained fabric.

Rd3=the reflectance of the washed fabric.

In Table I data was obtained with fabrics that were pre-treated with a 5% dispersion of either of two graft copolymers:

—VAc grafted to PET/POET

—VPr grafted to PET/POET

The solvent used to make the dispersion was made up with 95% ethanol and 5% water. Confidence levels (95% level) are shown in parenthesis.

TABLE I

PRE-TREATMENT WITH 5% GRAFT COPOLYMER DISPERSIONS IN 95% ETHANOL/5% WATER PERCENT SOIL RELEASE

| POLYMER | COTTON (S-405) | STAPLE POLY (S-777) | 65/35 BLEND (S-7435) |
|---|---|---|---|
| PET/POET/VAc | 31.0% (3.9) | 59.1% (2.7) | 73.4% (9.6) |
| ADVANTAGE OVER CONTROL | +5.5% | +56.1% | +66.0% |
| PET/POET/VPr | 30.1% (1.1) | 58.3% (5.9) | 61.3% (4.6) |
| ADVANTAGE OVER CONTROL | +4.6% | +55.3% | +61.3% |
| NO POLYMER (CONTROL) | 25.5% (2.8) | 3.0% (0.5) | 7.4% (3.0) |

As Table I indicates, 5% dispersions of PET/POET/-VAc and PET/POET/VPr graft copolymers provide significant soil release performance on cotton, staple polyester and Dacron (65)/cotton (35) blend fabrics.

Table II shows additional experiments which were carried out at lower dispersion concentrations, i.e. 2% active. TABLE

II

PRE-TREATMET WITH 2% DISPERSIONS OF GRAFT COPOLYMERS IN 95% ETHANOL/5% WATER PERCENT SOIL RELEASE

| POLYMER | COTTON (S-405) | STAPLE POLY (S-777) | 65/35 BLEND (S-7435) |
|---|---|---|---|
| PET/POET/VAc | 29.0% (1.8) | 51.2% (3.2) | 54.2% (2.5) |
| ADVANTAGE OVER CONTROL | — | 47.8% | 46.1% |
| PET/POET/VPr | 27.0% (2.4) | 48.0% (1.9) | 51.0% (1.5) |
| ADVANTAGE OVER CONTROL | — | 44.6% | 42.9% |
| NO POLYMER (CONTROL) | 27.1% (2.1) | 3.4% (1.3) | 8.1% (1.2) |

These results show that 2% dispersions of PET/POET graft copolymers are also very effective at imparting a soil release finish to both polyester and polyester/cotton fabrics.

While the invention has been described in each of its various embodiments, it is to be understood that modifications thereof may occur to those skilled in the art without departing from its true spirit and scope as set forth in the accompanying claims.

What is claimed is:

1. A method for the pretreatment of fabrics and textiles to impart soil release properties thereto, which comprises contacting said fabrics and textiles with a dispersion of a graft copolymer of:

(a) about 1 part by weight of at least one polycondensate comprising polyethylene terephthalate and polyoxyethylene terephthalate units, said polycondensate being grafted with (b) from about 0.2 to 10 parts by weight of at least one ester selected from the group consisting of vinyl acetate and vinyl propionate, and thereafter removing said fabrics and textiles from said dispersion and drying said fabrics and textiles, leaving solids from the dispersion deposited thereon.

2. The method as claimed in claim 1, wherein said fabric and textile surfaces are selected from the group consisting of polyester and polyester blends.

3. The method as claimed in claim 1, wherein said dispersion is not greater than about 5% dispersion of said graft copolymer in a mixture of ethanol and water.

4. The method as claimed in claim 3, wherein said dispersion is not greater than about 2% dispersion of said graft copolymer.

5. The method as claimed in claim 1, wherein said ester is vinyl acetate.

6. The method as claimed in claim 1, wherein said ester is vinyl propionate.

7. The method as claimed in claim 1, wherein said ester is a mixture of vinyl acetate and vinyl propionate.

8. The method as claimed in claim 1, wherein said contacting comprises immersing and soaking said fabrics in said dispersion.

9. The method as claimed in claim 1, wherein the ratio of polyethylene terephthalate to polyoxyethylene terephthalate is from about 2:1 to 6:1.

10. The method as claimed in claim 9, wherein the ratio of polyethylene terephthalate to polyoxyethylene terephthalate is from about 3:1 to 4:1.

11. The method as claimed in claim 10, wherein the ratio of polyethylene terephthalate to polyoxyethylene terephthalate is about 3:1.

12. Fabrics treated according to the method as claimed in claim 1.

* * * * *